US006070547A

United States Patent [19]

Achord

[11] Patent Number: 6,070,547

[45] Date of Patent: Jun. 6, 2000

[54] SURFACE CLEANING DEVICE AND RELATED METHOD

[75] Inventor: Cecil L. Achord, Chesapeake, Va.

[73] Assignee: Seaward Marine Services, Inc., Fairfax, Va.

[21] Appl. No.: 09/074,513

[22] Filed: May 8, 1998

Related U.S. Application Data

[60] Provisional application No. 60/046,632, May 16, 1997.

[51] Int. Cl.[7] ..... B63B 59/00

[52] U.S. Cl. ..... 114/222; 15/1.7

[58] Field of Search ..... 114/222, 221 R; 15/1.7

[56] References Cited

U.S. PATENT DOCUMENTS

| | | | |
|---|---|---|---|
| 3,906,572 | 9/1975 | Winn | 114/222 |
| 4,052,950 | 10/1977 | Hirata | 114/222 |
| 4,574,722 | 3/1986 | Orita et al. | 114/222 |
| 4,697,536 | 10/1987 | Hirata | 114/222 |
| 5,174,222 | 12/1992 | Rogers | 114/222 |

*Primary Examiner*—Jesus D. Sotelo

*Attorney, Agent, or Firm*—Finnegan, Henderson, Farabow, Garrett & Dunner, L.L.P.

[57] ABSTRACT

A surface is cleaned by a cleaning mechanism resulting in debris. First and second fluid flow paths are provided. The first fluid flow path removes the debris from the area of the cleaning mechanism and the second fluid flow path operates to hold the cleaning mechanism against the surface without debris contamination.

30 Claims, 10 Drawing Sheets

SURFACE CLEANING DEVICE AND RELATED METHOD

The present invention claims rights under 35 U.S.C. § 119 on Provisional Application No. 60/046,632, filed on May 16, 1997 and entitled "CLOSED CYCLE HULL CLEANING PLATFORM."

BACKGROUND OF THE INVENTION

I. Field of the Invention

The present invention relates to a surface cleaning device and related method.

II. Background Information

The SCAMP™ underwater hull cleaning device was first introduced in 1971. In its present form, SCAMP™ is an underwater cleaning machine six feet in diameter and holds three large rotating brushes. Traveling across a ship's hull on three traction wheels, the SCAMP™ machine is either controlled by a professional diver or operated remotely to advance, stop, reverse, or hold a parallel line of motion as it makes approximately a five foot cleaning swath.

The SCAMP™ hull cleaning device includes a center impeller which was the subject of U.S. Pat. No. 3,906,572 issued to Winn, the contents of which are expressly incorporated herein by reference. The center impeller generates a pressure differential on the underside of the SCAMP™ device that allows the device to be held against the hull of a ship and that permits the three brushes to rotate at approximately 120 rpm with the sole purpose of optimizing cleaning and minimizing paint damage. Other prior art hull cleaning machines operate their brushes at relatively higher speeds in order to create a centrifugal force to clamp the machine against the ship's hull. In addition, the use of the clamping impeller as shown in the Winn patent permits a wider inventory of brush configurations than that available on machines without center impellers. Specifically, the Winn configuration permits brushes to operate employing the sides of the brush bristles. Cleaning is accomplished by a scything action rather than a harsh scrubbing with the tips of the stiff bristles as is common with other apparatus and related methods. As a result, the prior SCAMP™ device does not damage functioning protective coatings to the extent those coatings may be at risk with more conventional prior art devices.

Due to the saucer shape of the SCAMP™ housing and the action of the impeller, the device clamps to the hull surface with a net clamping force of about 570 kgf. The traction effect on the wheels is approximately 204 kgf so that the SCAMP™ underwater hull cleaning device can be used effectively against tidal forces of up to three knots. The SCAMP™ underwater hull cleaning device had been approved for use at oil tanker terminals as well as in harbors with stringent environmental controls. Its use is desirable because independent studies have shown that this operation was thought not to impact meaningfully on the quality of the waters of an estuary or harbor.

The prior art SCAMP™ device, however, has no provision for collecting debris or effluent which may result from the underwater hull cleaning operation. Rather, the prior art SCAMP™ device simply discharges a plume of water back into the sea.

In the intervening years since the introduction of SCAMP™, underwater hull cleaning has changed significantly. The chemical composition of underwater paint has been modified, whereby copper and cuprous oxide (in depleted paint, and also attached to marine growth) may be released by underwater cleaning. In addition, the passage of the Clean Water Act has heightened concern among various federal and state environmental agencies regarding the potential impact of hull cleaning on the ambient water.

Thus, the process of underwater hull cleaning is being subjected to extensive evaluation with respect to its potential impact on the environment. In fact, pending certain test results, underwater hull cleaning of painted surfaces is temporarily suspended in certain ports. Accordingly, one Navy laboratory has contracts in place to develop an automated hull maintenance vehicle (AHMV), seeking the design of a new machine with the ability to effectively collect debris and effluent. The assignee of the present invention is a subcontractor to two principal contractors for this effort. However, the present invention was conceived and developed without the benefit of any government funds.

Competitors to the assignee have also developed hull cleaning apparatus. For example, U.S. Pat. No. 5,174,222 discloses an apparatus for cleaning ship hulls known commercially as the SEAVAC™ device. As may be seen in the '222 patent, the SEAVAC device employs the same general concept of a center impeller to hold the machine against the hull of a ship during the cleaning process. However, as is true with the prior SCAMP™ design, the SEAVAC device has no ability to collect debris and effluent.

SUMMARY OF THE INVENTION

It is, accordingly, an object of the present invention to provide a hull cleaning apparatus and related method that maintains the advantages of the prior SCAMP™ machine, but that includes the capacity to collect debris and effluent resulting from underwater hull cleaning operations.

Additional objects and advantages of the invention will be set forth in the description that follows, and, in part, will be obvious from the description or may be learned by the practice of the invention. The objects and advantages of the invention will be realized and attained by means of the elements and combinations particularly pointed out in the appended claims.

To achieve the foregoing objects, and in accordance with the purposes of the invention, as embodied and broadly described herein, a hull cleaning device is disclosed that includes a housing having one or more first and second chambers, with the first chambers preferable formed as subchambers of the second chamber. In the preferred embodiment each first chamber contains a plurality of rotating brushes adapted to act upon the surface of a hull, the second chambers each including an impeller adjacent a channel opened to the exterior of the housing and adapted to, when operating, discharge water through one fluid path from the interior of the housing to the exterior in sufficient force to hold the brushes against the surface of the hull. Preferably, the interior of the housing is divided internally to form the first chambers, one for each brush, with the first chambers being essentially isolated from the one fluid path and, therefore, from the central impeller, to define a plurality of other fluid paths, and the housing chamber further including a manifold coupled to each of the first chambers to extract water along the other fluid path from those first chambers to an external filtering system, the remaining portion of the interior of the second chamber continuing to be accessible to the impeller and having a sufficient area to continue to permit the impeller to hold the brushes in operation against the hull of a ship. Preferably, a plurality of traction wheels are located in the second chamber area exterior to the brush containing first chambers.

The foregoing design permits debris and effluent that are loosened by the operating brushes to be captured through the manifold system and treated by an external filter, while at the same time permitting operation of a central impeller of the type generally used in the prior art SCAMP™ configuration in order to hold the hull cleaning device against the ship during operation. Since the impeller is essentially isolated from the operation of the brushes, water passing through the impeller should be substantially free of debris and effluent from the operation of the brushes. Thus, there is no need to provide additional filtering of the impeller output to meet the objectives of the invention.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of the specification, illustrate a preferred embodiment and several alternative embodiments of the invention and, together with the general description of the invention given above and the more detailed description of the preferred embodiment and alternative embodiments given below serve to explain the principles of the invention.

DESCRIPTION OF THE PREFERRED EMBODIMENT

Reference will now be made in detail to the present preferred embodiment and exemplary embodiments of the invention, examples of which are as illustrated in the accompanying drawings.

Figure 1:
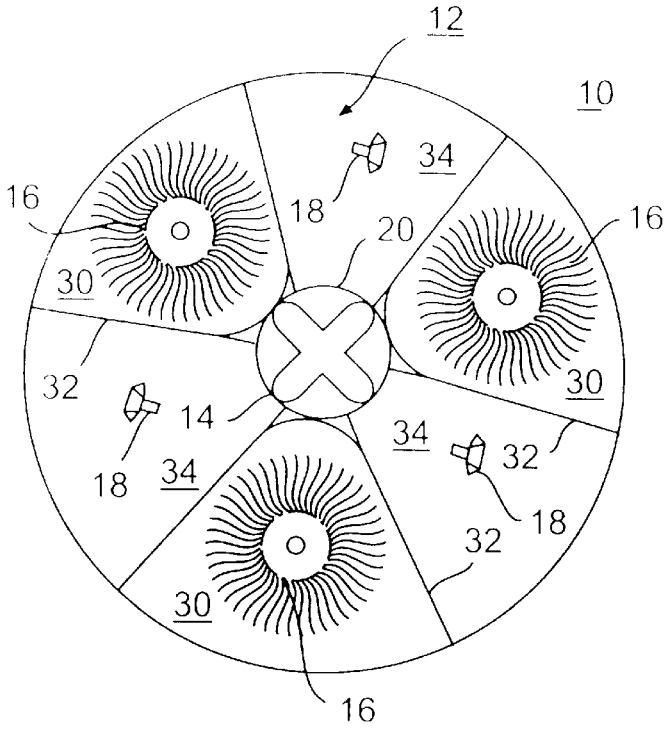
FIG. 1 is a bottom view of one embodiment of a hull cleaning device incorporating the teachings of the present invention.
Figure 2:
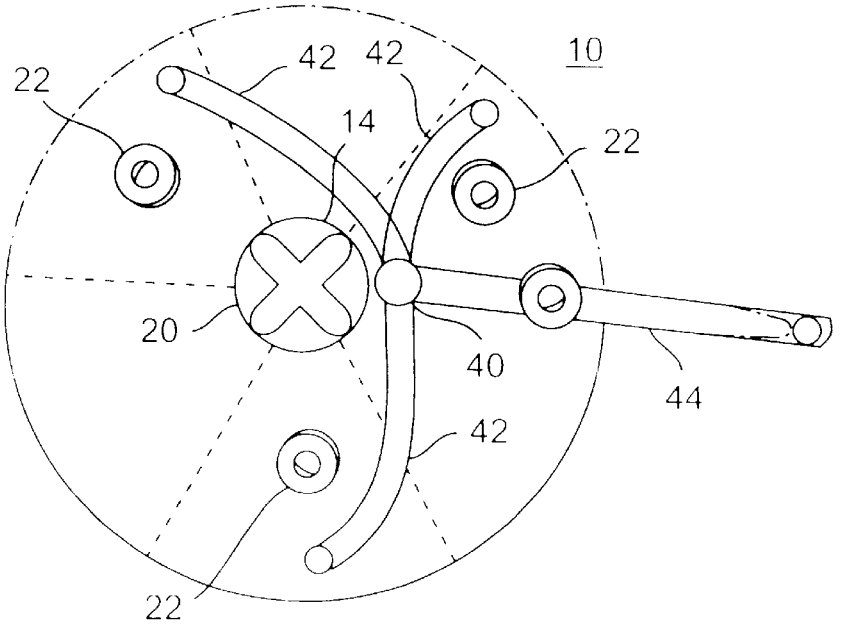
FIG. 2 is a top view of the same embodiment of the hull cleaning device incorporating the teachings of the present invention.

In FIGS. 1 and 2, there is shown a hull cleaning device 10 having a housing of general saucer shape and that defines an internal chamber 12. Device 10 includes, associated with chamber 12, a central impeller 14, a plurality of cleaning brushes 16, and a plurality of traction wheels 18. As should be understood by those skilled in the art, impeller 14 is opened to the exterior of chamber 12 by means of an opening 20 through which a large plume of water may pass in sufficient volume to produce a net clamping force of approximately 500 kg for more, sufficient to hold brushes 16 against the surface of a hull during operation. Preferably, brushes 16 are three in number and are equally spaced about the interior of chamber 12. As should be appreciated by those skilled in the art, brushes 16 are made to rotate by a plurality of motors 22 situated on the exterior of device 10. In operation brushes 16 are movable relative to a surface to be freed of debris and are made to rub against that surface. Wheels 18 are preferably motor driven and at least one is capable of being selectively oriented so as to control the direction of movement of device 10.

In accordance with the teachings of the present invention, first and second fluid flow paths are sufficiently isolated from one another so that debris from a surface cleaning mechanism, such as brushes 16, enters the first path and is retarded from entering the second path. For example, as shown in FIG. 1, chamber 12 is divided into a number of subchambers 30 by a plurality of shrouds 32. Preferably, subchambers 30 are arranged symmetrically about central impeller 14 and are spaced from one another so as to leave open chamber portions 34 for access to impeller 14. Chamber portions 34 permit a source of fluid flow along the second path sufficient, when impeller 14 is operating, to hold device 10 against a surface. Shrouds 32 of subchambers 30 permit a source of fluid flow along the first path sufficient to remove the debris from device 10. A manifold 40 is configured to communicate with each of subchambers 30 and to an external filtering mechanism, not shown, such as for example an Amiad EBS Series filtration system. For example, as shown in FIG. 2, a plurality of two inch vacuum tubes 42 may be arranged on the external surface of device 10 to communicate with each subchamber 30. A four inch hydraulic vacuum pump line 44 communicates the manifold 40 and vacuum tubes 42 to the external filter system.

Accordingly, the modified SCAMP™, which is the subject of one embodiment of the present invention, facilitates collection and treatment of "contaminated effluent" (i.e., possibly containing marine growth and paint particles) resulting from an underwater hull cleaning process. In the past, to the best of applicant's knowledge, this goal has not been achieved in practice in commercial application, primarily because the volume of water produced by the impeller of the current commercially available standard, namely SCAMP™, is too great. Instead of attempting to deal with this large volume effluent, applicant has separated the conventional effluent into two water flows by creating cavities and channels in the face portion or main housing chamber of the SCAMP™ machine body. Thus, as the SCAMP™ modified body rides along the hull, a flow necessary to maintain a clamping force (without significant debris produced by the underwater hull cleaning process) continues through the impeller, while the contaminant effluent is separately routed to an external filter. Further segregation of the water flow may be achieved and ensured by the addition of semi-rigid "skirts" or shrouds surrounding the cavities and positioned roughly perpendicular to the surface being cleaned.

Figure 3:
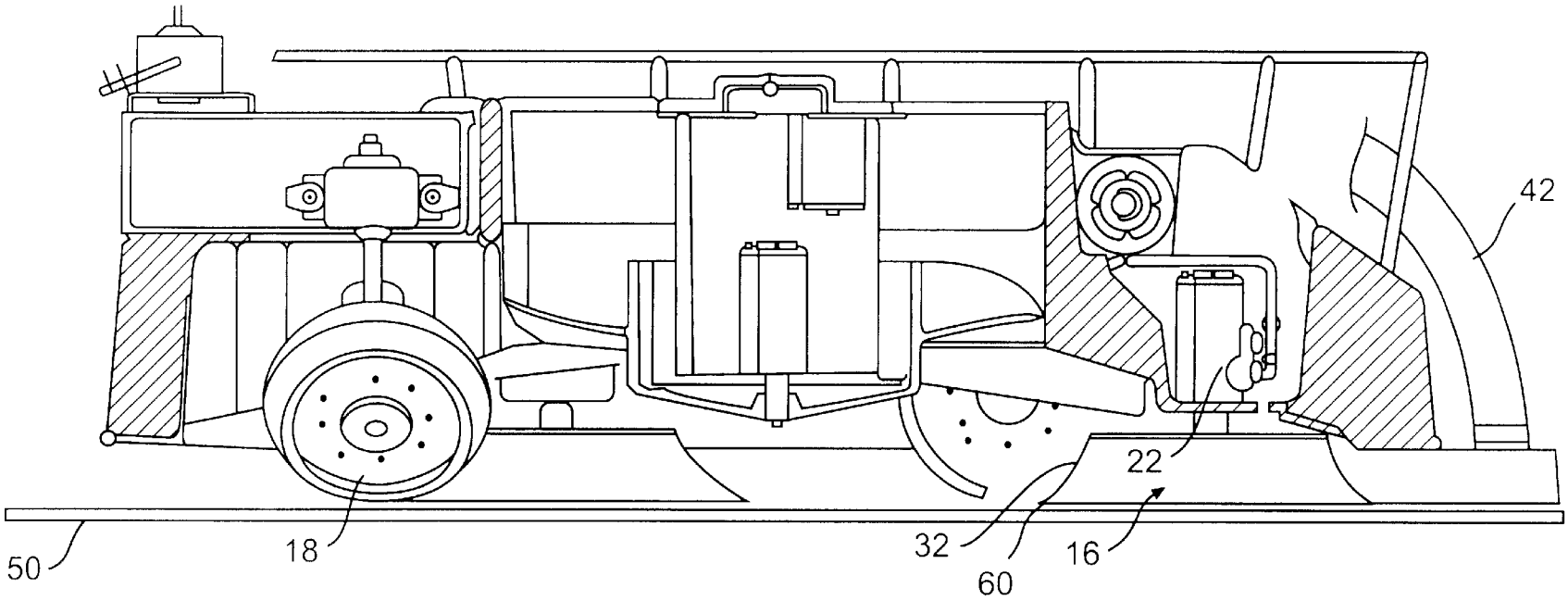
FIG. 3 is a partial sectional view of an embodiment of the present invention showing the structure of the embodiment from the side.
Figure 4:
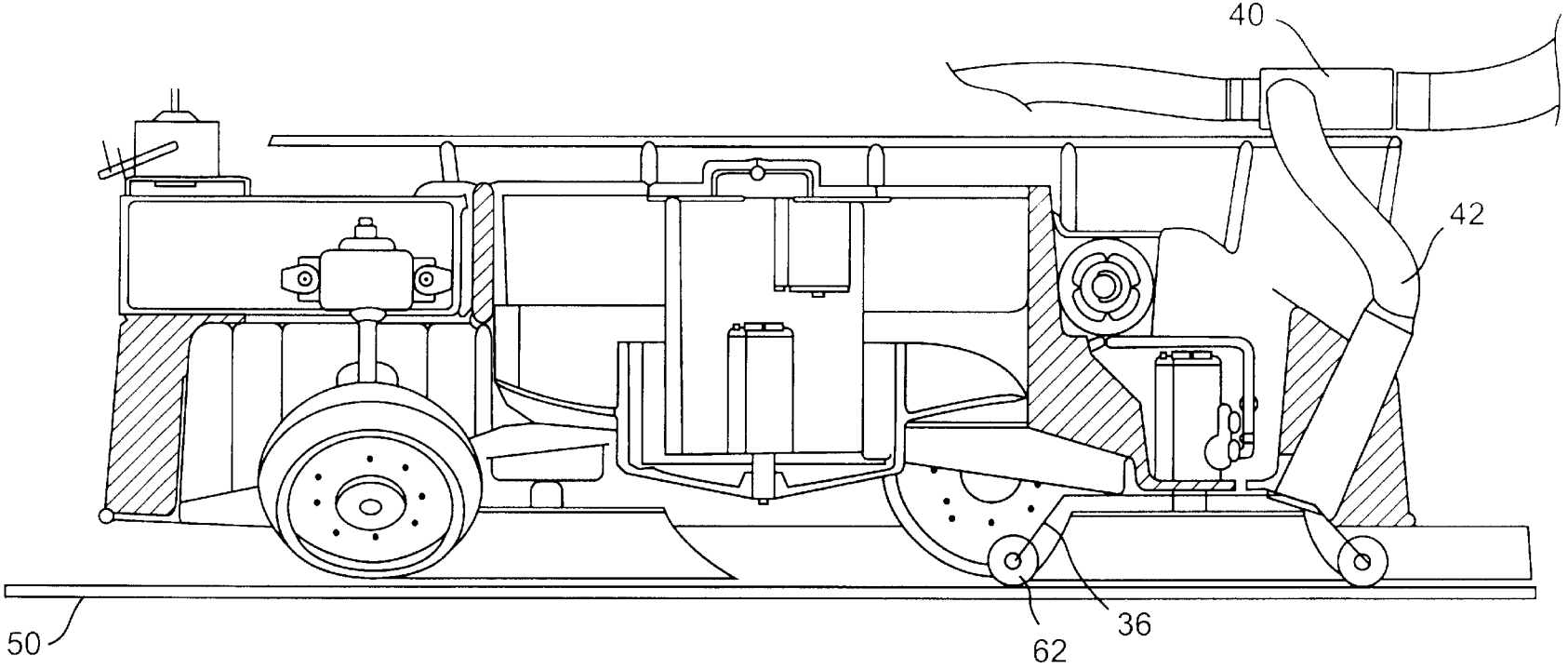
FIG. 4 is a partial sectional view of an alternative embodiment of the present invention showing the structure of the embodiment from the side.
Figure 5:
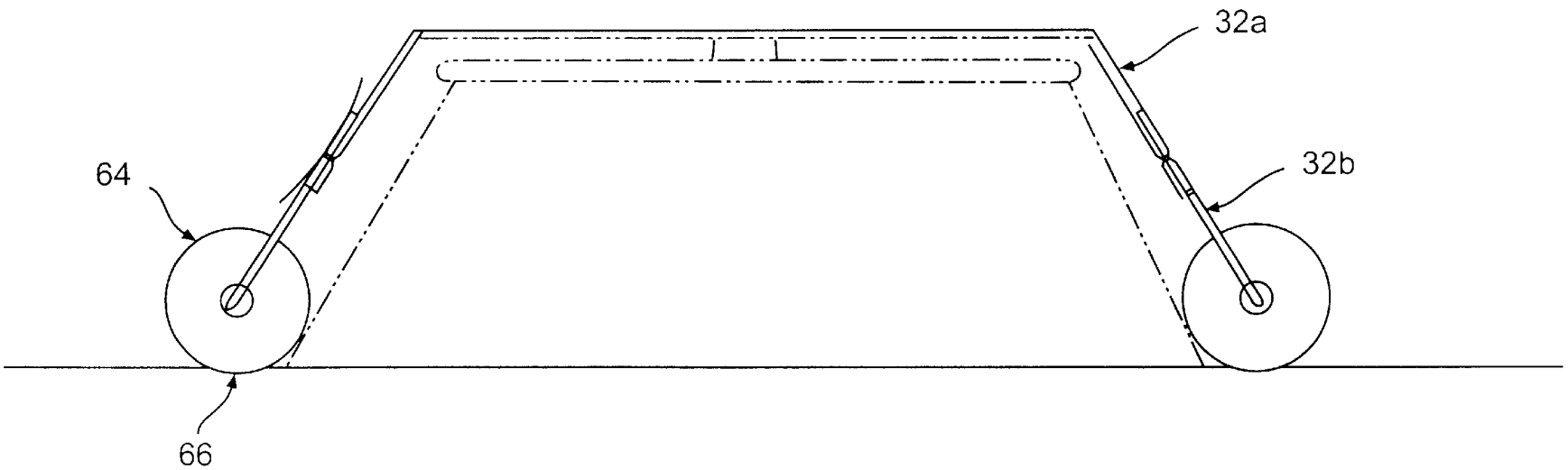
FIG. 5 is a partial side view of an embodiment of a shroud assembly.

For example, in an alternative embodiment of this invention, the cleaning device may be employed with a seal or trim provided at the end of the shroud as depicted in FIG. 3. This seal 60 may be formed of various materials such as rubber, foam pipe insulation wrap or any such flexible material which allows the cleaning device to adjust to uneven hull surfaces and not damage the hull surface. The use of foam materials may require a coating of hard rubber or other durable material such as Herculite™ or Kevlar™. FIG. 3 depicts shroud 32 that is preferably formed of steel with seal 60 that is preferably formed of rubber in contact with a surface 50. Shroud 32 extends out to vacuum tubes 42. FIG. 4 depicts another alternative embodiment of this invention wherein a seal 62 is made of a thicker material such as foam insulation and is attached to a smaller flexible shroud 36. FIG. 5 depicts yet another alternative shroud assembly. In the embodiment depicted in FIG. 5, the shroud is divided into a metal shell 32*a* and a flexible lower portion 32*b* made of material such as plastic or rubber that attaches to a seal 64. Seal 64 is wrapped in a coating 66 of a durable material such as Herculite™ or Kevlar™.

Figure 6:
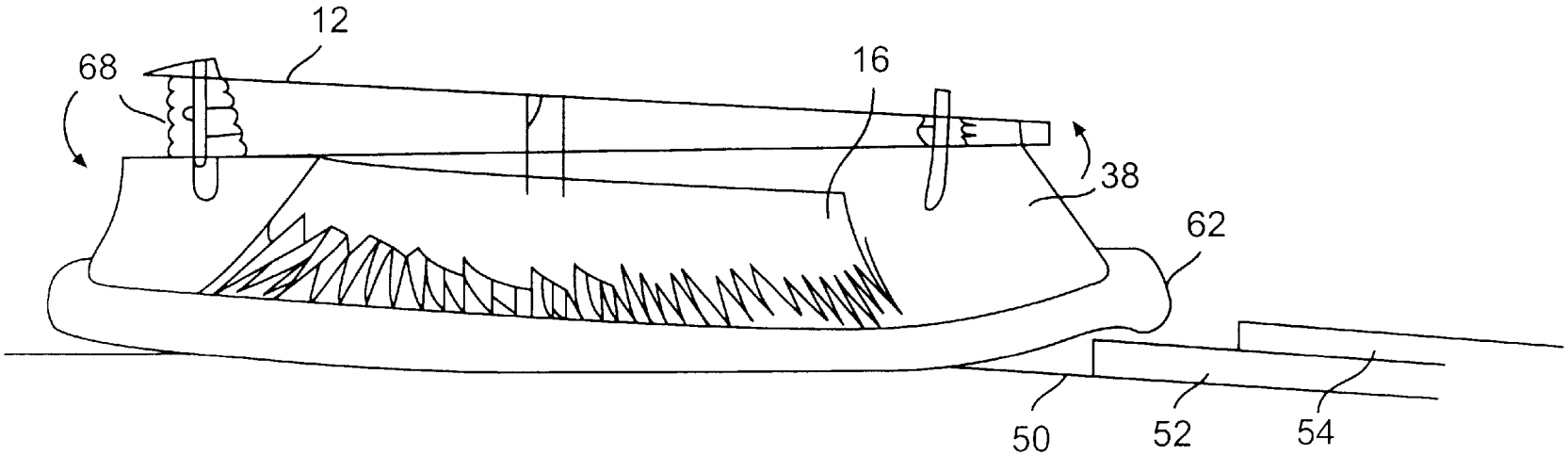
FIG. 6 is a partial side view of an alternative embodiment of a shroud assembly.

As a result of ship hull construction and repair, overlapping plates of steel or other materials often times lead to steps or unevenness in the surface of the hull. In a further alternative embodiment depicted in FIG. 6, subchambers 30 are positioned by spring pins 68 at the interface between a shroud 38 and chamber 12 to allow shroud 38 to pivot when it comes into contact with discontinuities or unevenness in surface 50 being cleaned. By allowing shroud 38 to pivot in such a manner, the fluid flow around brushes 16 or other rubbing devices can be maintained while device 10 moves across uneven surfaces 52, 54. This added flexibility in the orientation of the subchamber reduces disruption of the effluent flow through the manifold or the redirection of effluent to the central impeller flow.

Figure 7:
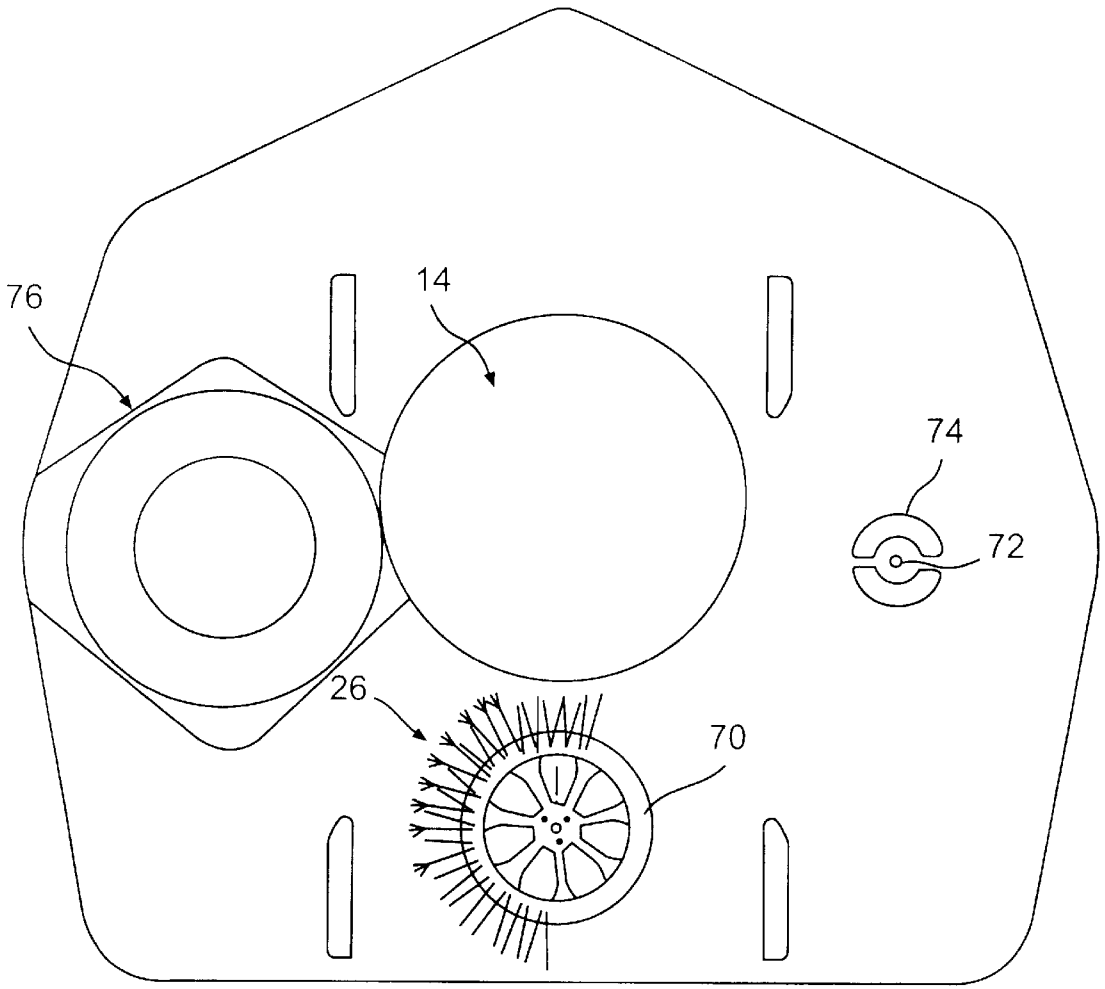
FIG. 7 is a bottom cutaway view of an alterative embodiment of a hull cleaning device of the present invention depicting the elements of the invention in various levels of assembly.
Figure 8:
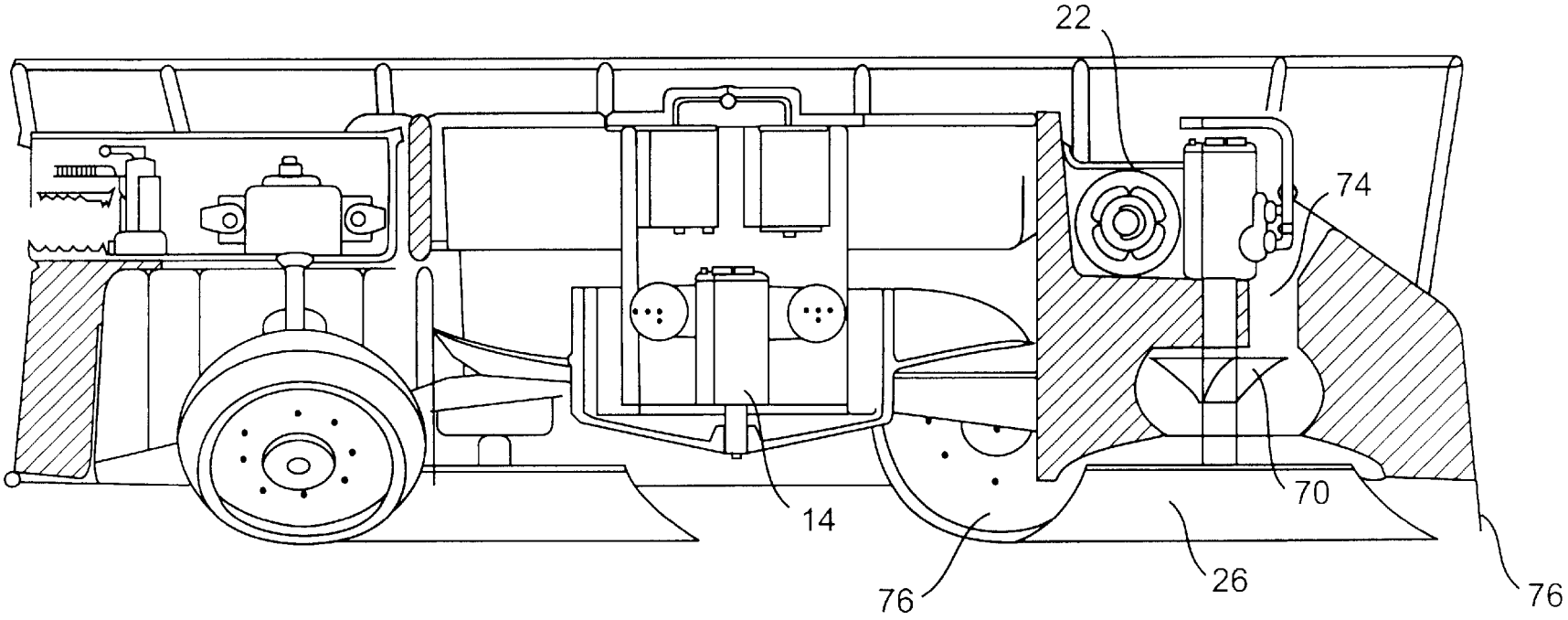
FIG. 8 is a side view of the embodiment of the present assembly depicted in FIG. 7.
Figure 9:
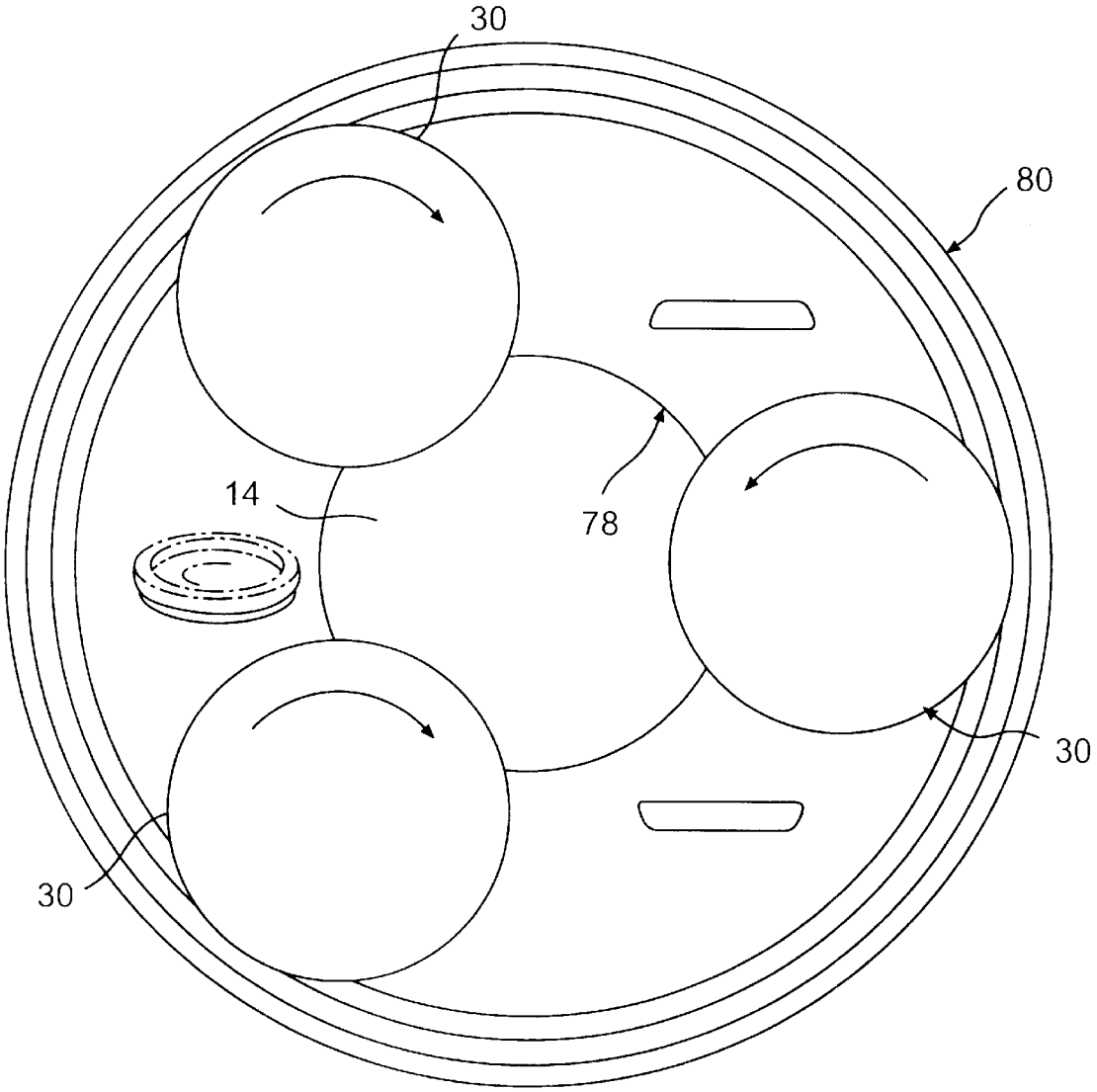
FIG. 9 is a bottom view of an additional alternative embodiment of the present invention.

In yet a further embodiment, as depicted in FIGS. 7 and 8, an impeller 70 can be centered on each brush 26 or other surface cleaning mechanism, separate from a central or main impeller 14, to directly remove effluent from that cleaning area. FIG. 7 provides a view of a bearing 72 for brush 26 unobstructed by impeller 70 or brush 26. FIG. 7 also provides a view of one embodiment of opening 74 provided for effluent to flow away from brush 26. Shroud 76 depicted in FIG. 7 can be made, for example, as a heavy rubber skirt. Additionally, as depicted in FIG. 9, a rubber skirt 78 can be added around impeller 14 to isolate the fluid flow through impeller 14 from the fluid flow through subchambers 30. Further modifications may also include the provision of a rubber skirt 80, as depicted in FIG. 9, about the entire periphery of device 10 to improve the control and isolation of the fluid flow in the various chambers and reduce the volumetric flow of water through the device.

The further addition of the above described seals and or skirts may allow for a reduction in the amount of pressure differential required to hold the cleaning device in place and, thus, allow for a reduction in impeller size and/or RPM. These seals should also allow for a reduction in the volume of effluent removed by the device, by blocking the flow of water from outside the subchamber into the subchamber for removal, and, thus, the volume of removed material which must be filtered or otherwise separately treated by a waste treatment or equivalent system or facility.

Figure 10:
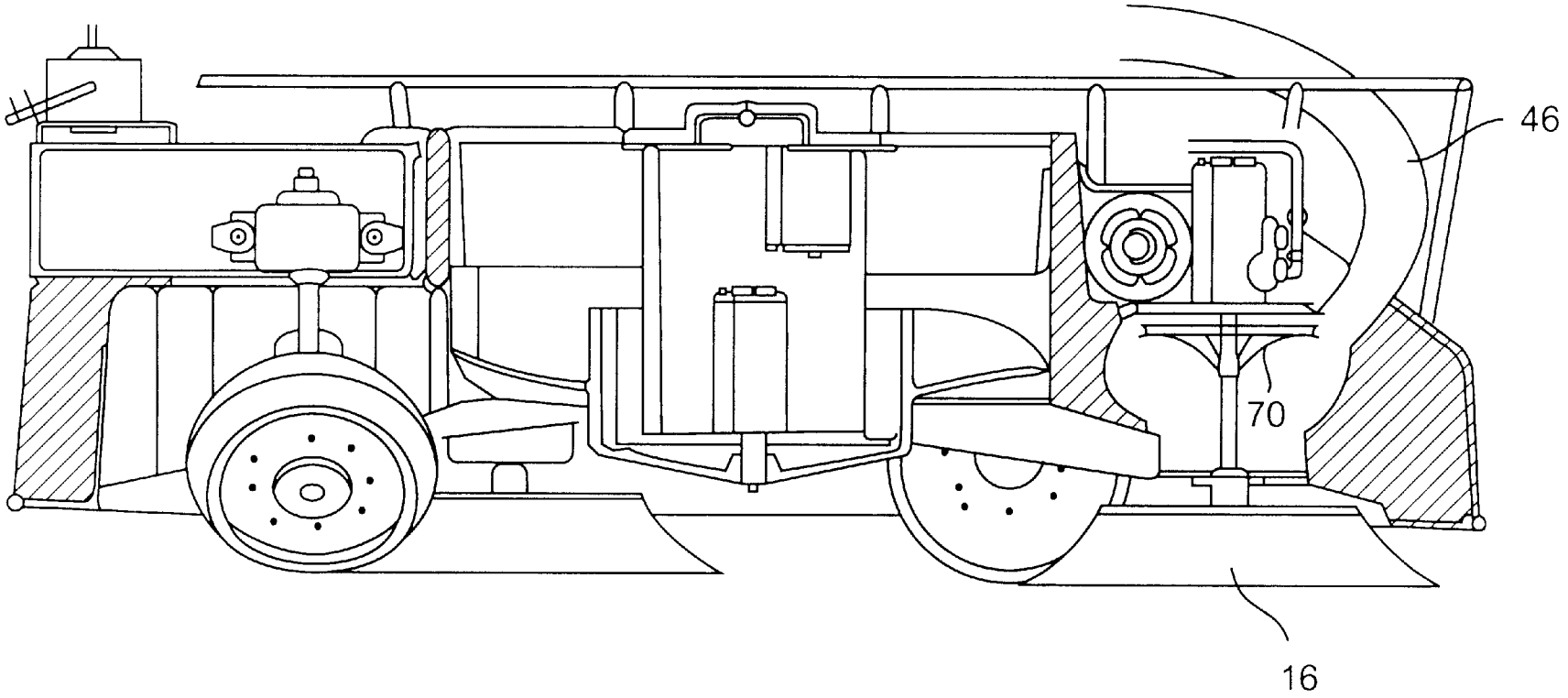
FIG. 10 is a side view of another alternative embodiment of the present invention.
Figure 11:
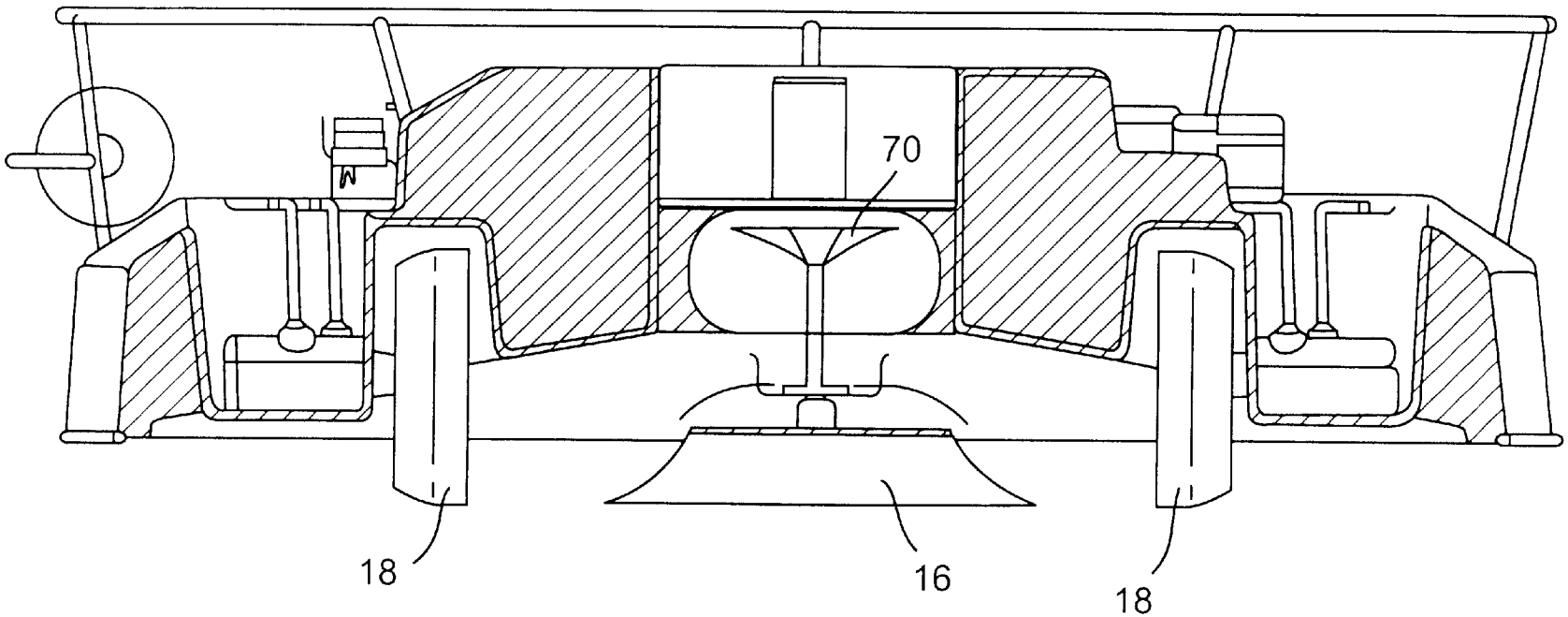
FIG. 11 is a 90° rotated view of FIG. 10.

Another alternative embodiment, as depicted in FIG. 10, does not include a shroud about brush 16 but does include impeller 70 coaxially mounted above the brush 16 provided for removal of debris through vacuum tube 46. FIG. 11 depicts a 90 degree rotated view of the embodiment depicted in FIG. 10. As shown by this embodiment, the subchambers do not require a physical barrier, such as a shroud or skirt. By use of the term subchamber, the applicant, therefore, intends that terminology to mean an area surrounding a surface cleaning mechanism defined by, for example, pressure forces, such as a first and second fluid flow, present in the area substantially close to and including a surface cleaning mechanism, with or without a physical partitioning by a shroud or skirt. In the embodiment described by FIGS. 10 and 11, no shroud is necessary so long as sufficient pressure differential is present in the area encompassing the brushes to remove debris and to substantially prevent debris from flowing to the main impeller for injection into the marine environment.

The contaminant effluent is preferably plumped though a flexible pipe to the water surface for treatment. By undertaking treatment of the contaminant effluent at the surface, the present invention is at variance with and far superior to the prior art wherein a "net bag" is employed (U.S. Pat. No. 4,052,950 issued to Hirata) or a "basket" (U.S. Pat. No. 4,697,536 issued to Hirata) is mounted on the cleaning machine in at least the following ways:

1. By their very nature, the net bag and basket must not obstruct the flow of effluent created by the cleaning machine and, therefore, can capture only relatively large solid matter. Smaller particles, including paint debris, are therefore passed directly through the mesh into the ambient water column;

2. By their very nature, the net bag and basket mounted on the underwater cleaning machine are severely capacity constrained, i.e., as they fill, they must be removed from the machine and replaced by empty bags or baskets or otherwise cleaned out and replaced. In either case, the resultant detrimental impact on efficiency of the cleaning process is so severe as to, for all practical purposes, rule out these methods; and 3. In the alternative case, if not exchanging the bags or baskets in the water, the entire machine with attached bags and baskets would need to be hoisted out of the water to support the bag and/or basket cleaning or replacement, assuming it were possible to lift the entire assembly out of the water without having the bags and/or baskets fall off. Again, the resultant detrimental impact on efficiency of the cleaning process is so severe as to apparently rule out this alternative.

By comparison, the proposed invention facilitates continuous treatment of the effluent, without the need for frequent stops to change any component of the underwater cleaning machines, thereby greatly enhancing the efficiency of the overall cleaning process, as compared to the attached bags or baskets concept.

The proposed invention, by significantly reducing the volume of contaminated water subject to treatment, facilitates use of a separation system to remove suspended and dissolved particles from the effluent stream. Such a filtration system need not be located on the machine, but may be land based or located on a floating platform. Accordingly, the underwater cleaning process is not subject to frequent interruption and is therefore inherently more efficient.

The proposed invention, thus, in its preferred embodiment, incorporates a separate separation mechanism which physically removes suspended and dissolved solids, including, but not limited to, macrofouling, microfouling, paint pigments and metals. The separation processes may include both filtration and ion exchange unit operations.

It will be apparent to those skilled in the art that other modifications and variations can be made in the cleaning apparatus of the present invention and in the construction of this device without departing from the scope or spirit of the invention. As an example, rather than employing rotating brushes for removing debris from the hull surface, the device may employ other rubbing devices such as those having abrasive or scouring surfaces which may move horizontally or vertically relative to and against the hull surface.

Moreover, by providing two sources of pressure differential holding the cleaning device against the ship hull, one by means of the central impeller, and one by means of the fluid drawn directly around the area of rubbing devices, such as brushes 16, in their separate subchambers 30, the proposed invention should make it possible to reduce the speed and size of the central impeller 14 and reduce the amount of water drawn through the central impeller 14 to the marine environment, disrupting that environment. The fluid flow through impeller 14 and/or brushes 16 can be optimized for best results and minimum impact to the environment. During testing of one embodiment of the present invention, 75 gl/min of vacuum was pulled around brushes 16 in subchambers 30 to remove the effluent from those subchambers 30.

Although the present invention has been described, in at least one embodiment, as including impeller 14 to provide pressure differential to hold the cleaning device to the surface to be cleaned, alternative holding sources can be provided within the scope of this invention. For example, rather than an impeller, the holding device included in the present invention may be a vacuum line provided from a pump or other pressure differential source or may be a large magnet which provides a magnetic force for holding the cleaning device against the surface to be cleaned. Thus, the cleaning device of the present invention may be held against the surface to be cleaned by forces other than pressure and by devices other than a central impeller.

Additionally, the force for holding the device against the surface to be cleaned and the force for removing the debris away from the surface to be cleaned, may be generated by the same device so long as the forces are separated in some manner, for example by separate tubes or manifolds, to allow the debris to be isolated from the force for holding.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A surface cleaning device comprising:

a surface cleaning mechanism that, when operated, results in debris;

first and second fluid flow paths, said cleaning mechanism located in said first path, said first and second path each having a respective origin exposed to said surface upon operation of said device, said first and second paths being sufficiently isolated from one another so as to substantially prevent the debris from said cleaning mechanism in said first path from entering said second path;

a first source of fluid flow coupled to said first path sufficient to remove fluid in said first path containing said debris from said device; and a second source of fluid flow coupled to said second path sufficient to hold said cleaning mechanism against said surface, wherein said second path is configured to allow fluid to exit from said device without substantial communication with fluid in said first path.

2. The device of claim 1, wherein said first source of fluid flow includes a fluid pump.

3. The device of claim 1, wherein said second source of fluid flow includes an impeller located near the center of said device.

4. The device of claim 1, wherein said surface cleaning mechanism includes a plurality of rotating brushes.

5. The device of claim 1, including separate exit openings for said first and second paths.

6. A surface cleaning device comprising:

a surface cleaning mechanism that, when operated, results in debris;

first and second fluid flow paths, said cleaning mechanism located in said first path, said first and second path each having a respective origin exposed to said surface upon operation of said device, said first and second paths being sufficiently isolated from one another so as to retard the debris from said cleaning mechanism in said first path from entering said second path;

a first source of fluid flow coupled to said first path sufficient to remove fluid in said first path containing said debris from said device; and a second source of fluid flow coupled to said second path sufficient, when said cleaning mechanism is operating, to hold said cleaning mechanism against said surface, wherein said first source of fluid flow includes a pump and said surface cleaning mechanism includes a plurality of rotating brushes, said first path further comprising a plurality of chambers having openings positionable against said surface, with at least one of said brushes located in a respective one of said chambers.

7. The device of claim 6, wherein said first path further includes a manifold interconnecting said chambers to said pump independent of said second fluid flow path.

8. A device for cleaning a surface comprising:

a housing having at least one each of first and second chambers;

at least one surface cleaning mechanism mounted in each first chamber;

a holding device operatively coupled to each second chamber and adapted to, when said cleaning mechanism is operating, exert sufficient force to hold said surface cleaning mechanism against the surface to be cleaned; and a pump operatively coupled to each said first chamber for removing from each said first chamber debris loosened from said surface by said surface cleaning mechanism.

9. The device of claim 8, wherein said surface cleaning mechanism includes at least one rotating brush.

10. The device claim 9 further comprising a motor attached to said housing and said at least one brush for rotating said at least one brush.

11. The device of claim 9, including a plurality of said first chambers, each of which is substantially equally spaced about the interior of said second chamber as subchambers of said second chamber and wherein said surface cleaning mechanism includes three brushes each positioned in a respective one of said first chambers.

12. The device of claim 11, wherein said plurality of first chambers is each formed by a respective shroud.

13. The device of claim 8, wherein said holding device includes a central impeller.

14. The device of claim 8, further comprising at least one shroud located in said second chamber adapted to divide said chamber into at least one subchamber, each of which subchamber forms a respective one of said first chambers.

15. The device of claim 14, further comprising a seal attached to said shroud and located at the interface between said shroud and the surface to be cleaned to further isolate each said first chamber from said second chamber.

16. The device of claim 15, wherein said seal is sufficiently flexible for allowing said device to move across an uneven surface to be cleaned without sufficiently disrupting the flow of debris formed in each said first chamber.

17. The device of claim 15, further comprising a spring attached between each said shroud and a structure fixed relative said housing for allowing each said first chamber to move relative to variations in the surface to be cleaned.

18. The device of claim 8, further comprising a flexible skirt around the outside of said housing.

19. The device of claim 18, further comprising a flexible skirt around the outside of said surface cleaning mechanism.

20. The device of claim 18, further comprising a flexible skirt around the outside of said second chamber.

21. The device of claim 8, further comprising a manifold coupled to each said first chamber for extracting debris from said first chamber.

22. The device of claim 21, wherein said manifold includes a plurality of tubes arranged on the external surface of said housing and each connected to one of said first chambers.

23. The device for cleaning a surface of claim 8, further comprising a plurality of traction wheels coupled to said housing.

24. A method for cleaning a submerged surface using a cleaning device comprising the steps of:

loosening debris on the surface by operation of a surface cleaning mechanism attached to the cleaning device;

removing said debris from said device using a first fluid flow;

holding said device against the surface to be cleaned using a second fluid flow isolated from said first fluid flow; and removing fluid from said device via said second fluid flow independent of said first fluid flow.

25. The cleaning process of claim 24, wherein the holding step includes the step of operating an impeller to create said second fluid flow.

26. The cleaning process of claim 24, wherein the loosening step includes the step of rotating brushes against the surface.

27. The cleaning process of claim 24, further including the step of filtering debris from the first fluid flow.

28. The cleaning process of claim 24, further comprising the step of substantially sealing the area around said cleaning mechanism to facilitate the removing of the debris via said first fluid flow.

29. A device for cleaning a submerged surface comprising:

a housing;

means, connected to said housing, for removing debris from said surface;

means, connected to said housing, for permitting transportation of said debris from said housing in a first fluid flow; and means, connected to said housing, for holding said system to the surface to be cleaned using a second fluid flow, said second fluid flow being substantially isolated from said first fluid flow containing said debris.

30. The cleaning process of claim 24, wherein the step of removing said debris from the device includes the step of operating a pump to create the first fluid flow.

* * * * *